US006703174B2

(12) United States Patent
Kitamura et al.

(10) Patent No.: US 6,703,174 B2
(45) Date of Patent: Mar. 9, 2004

(54) ELECTROPHOTOGRAPHIC APPARATUS AND PROCESS CARTRIDGE

(75) Inventors: Wataru Kitamura, Abiko (JP); Hideki Ogawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,425

(22) Filed: Jan. 30, 2002

(65) Prior Publication Data

US 2003/0043253 A1 Mar. 6, 2003

(30) Foreign Application Priority Data

Jan. 31, 2001 (JP) ..... 2001-023869

(51) Int. Cl.[7] ..... G03G 5/06
(52) U.S. Cl. ..... 430/59.5; 430/59.4; 399/159
(58) Field of Search ..... 430/59.4, 59.5; 399/159

(56) References Cited

U.S. PATENT DOCUMENTS

| | | | | |
|---|---|---|---|---|
| 3,837,851 | A | 9/1974 | Shattuck et al. | 96/1.5 |
| 3,871,880 | A | 3/1975 | Montillier | 96/1.5 |
| 4,507,471 | A | 3/1985 | Ohta | 534/755 |
| 4,618,672 | A | 10/1986 | Hashimoto | 534/658 |
| 4,743,523 | A | 5/1988 | Yamashita et al. | 430/59 |
| 4,788,119 | A | 11/1988 | Yamashita et al. | 430/58 |
| 4,898,799 | A | 2/1990 | Fujimaki et al. | 430/59 |
| 5,132,197 | A | 7/1992 | Iuchi et al. | 430/76 |
| 5,665,500 | A | 9/1997 | Suzuki | 430/59 |
| 5,747,208 | A | 5/1998 | Ueda | 430/97 |

FOREIGN PATENT DOCUMENTS

| | | |
|---|---|---|
| EP | 0 707 238 | 4/1996 |
| JP | 56-167759 | 12/1981 |
| JP | 57-195767 | 12/1982 |
| JP | 61-228453 | 10/1986 |
| JP | 61-239248 | 10/1986 |
| JP | 61-272754 | 12/1986 |
| JP | 62-67094 | 3/1987 |
| JP | 64-17066 | 1/1989 |
| JP | 3-54264 | 3/1991 |
| JP | 3-128973 | 5/1991 |
| JP | 4-51043 | 2/1992 |

OTHER PUBLICATIONS

Patent Abstracts of Japan, vol. 18, No. 557, Oct. 24, 1994 (JP 6–202357) Jul. 22, 1994.

*Primary Examiner*—Mark A. Chapman
(74) *Attorney, Agent, or Firm*—Fitzpatrick, Cella, Harper & Scinto

(57) ABSTRACT

An electrophotographic apparatus includes an electrophotographic photosensitive member comprising a support and a photosensitive layer thereon, a charging means for charging the photosensitive member, a multi-beam exposure means for illuminating the photosensitive member with a plurality of laser beams to form an electrostatic latent image on the photosensitive member, a developing means for developing the electrostatic latent image to form a toner image on the photosensitive member, and a transfer means for transferring the toner image from the photosensitive member to a transfer-receiving material. The electrophotographic apparatus is not equipped with a charge-removal means for uniformly charge-removing the photosensitive member in advance of operation of the charging means. Further, the photosensitive member has a photosensitive layer containing oxytitanium phthalocyanine and exhibits a charge mobility of $7.0\times10^{-5}$ to $2.0\times10^{-5}$ $cm^2$/volt.sec. As a result, the electrophotographic apparatus can provide a higher process speed and/or a higher resolution because of the multi-beam exposure means without causing a density difference regardless of laser beam emission state.

16 Claims, 2 Drawing Sheets

ELECTROPHOTOGRAPHIC APPARATUS AND PROCESS CARTRIDGE

FIELD OF THE INVENTION AND RELATED ART

The present invention relates to an electro-photographic apparatus and a process-cartridge.

In recent years, electrophotographic photosensitive members comprising various organic photoconductor compounds as principal components have been extensively developed. For example, U.S. Pat. No. 3,837,851 has disclosed an electrophotographic photosensitive member having a charge transport layer comprising a triarylpyrazoline.

U.S. Pat. No. 3,871,880 has disclosed an electrophotographic photosensitive member having a charge generation layer comprising a perylene pigment derivative and a charge transport layer comprising a 3-propylene-formaldehyde condensate.

Organic photoconductor compounds have their own different sensitive wavelength regions. For example, Japanese Laid-Open Patent Application (JP-A) 61-272754 and JP-A 56-167759 disclose compounds showing a high sensitivity to a visible region.

JP-A 57-195767 and JP-A 61-228453 disclose compounds showing a high sensitivity to an infrared region.

Among these compounds, those having a sensitivity to an infrared region are used in laser beam printers, digital copying machines and LED printers, and the demand therefor is becoming intense.

As representative charge-generating substances showing a sensitivity to the infrared region, phthalocyanines are known, and among these, oxytitanium phthalocyanine showing a high sensitivity has been extensively studied.

For example, oxytitanium phthalocyanine is 10 known to have many crystal forms similar to other phthalocyanine compounds, and many studies thereon have been made.

Specific examples of such crystal forms may include those disclosed in JP-A 61-239248, JP-A 62-67094, JP-A 1-17066, JP-A 3-54264, and J7P-A 3-128973.

Oxytitanium phthalocyanine has a high sensitivity, but is accompanied with a problem that its potential characteristic is liable to vary on repetitive use.

On the other hand, as exposure means for forming electrostatic latent images on an electrophotographic photosensitive member, it has been known to use a rotating multi-face mirror (so-called a polygonal mirror as used hereinbelow) for reflecting a laser beam from a semiconductor laser to illuminate the photosensitive member surface.

In the case of such exposure means using a laser beam, it is necessary to accelerate the laser beam scanning speed in order to realize high-resolution output images or high-speed output images by using a single laser beam. However, a certain upper limit is present regarding the rotation speed of a polygonal mirror.

Accordingly, for solving the problem, there has been proposed and realized a multi-beam (scanning) scheme wherein an electrophotographic photosensitive member is scanned with a plurality of laser beams simultaneously.

The multi-beam scheme has the advantages described below.

In the case of using an identical laser beam scanning speed for realizing an identical printing speed in an image forming apparatus using a number (n) of laser beams, the scanning line density can be raised to n-times that in an apparatus using a single laser beam, thus making it possible to realize a higher-resolution image recording.

On the other hand, in the case of realizing identical scanning speed and scanning density of laser beam as in the case of a single laser beam scheme, the printing speed can be raised as high as n times. Further, in the case of using identical printing speed and scanning density, it becomes possible to lower the laser beam scanning speed and accordingly the rotation speed of a polygonal mirror to 1/n times those in the single-beam scheme, thus allowing simplification of the polygonal mirror drive mechanism and a lower production cost.

However, in an already realized electrophotographic apparatus using exposure means of the multi-beam scheme, there has been encountered a difficulty that output image densities can be different regardless of identical electrostatic latent image formation depending on whether a plurality of adjacent laser beams are emitted simultaneously or the laser beams are emitted individually and sequentially.

Moreover, in an electrophotographic apparatus not equipped with a charge-removal means, such as pre-exposure means, a ghost phenomenon is liable to be more pronounced that an image of a subsequent cycle is affected by a history of an exposed part in a preceding cycle than in the case of using a single laser beam.

These phenomena are liable to occur more noticeably in the case of using oxytitanium phthalocyanine as a charge-generating substance for an electrophotographic photosensitive member.

SUMMARY OF THE INVENTION

An object of the present invention is to provide an electrophotographic apparatus which is less liable to cause a density difference regardless of laser beam emission state, or ghost or potential fluctuation on repetitive use even in a system of using a multi-beam exposure means and without a charge-removal means, such as pre-exposure means.

Another object of the present invention is to provide a process-cartridge for such an electro-photographic apparatus.

According to the present invention, there is provided an electrophotographic apparatus, including: an electrophotographic photosensitive member comprising a support and a photosensitive layer thereon, a charging means for charging the photosensitive member, a multi-beam exposure means for illuminating the photosensitive member with a plurality of laser beams to form an electrostatic latent image on the photosensitive member, a developing means for developing the electrostatic latent image to form a toner image on the photosensitive member, and a transfer means for transferring the toner image from the photosensitive member to a transfer-receiving material, wherein the electrophotographic apparatus is not equipped with a charge-removal means for uniformly charge-removing the photosensitive member in advance of operation of the charging means, and the photosensitive member has a photosensitive layer containing oxytitanium phthalocyanine and exhibits a charge mobility of $7.0\times10^{-5}$ to $2.0\times10^{-5}$ $cm^2$/volt.sec.

The present invention further provides a process-cartridge which includes the photosensitive member and at least one of the charging means and the developing integrally supported to form a unit, and is detachably mountable to a main assembly of the above-mentioned electrophotographic apparatus.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
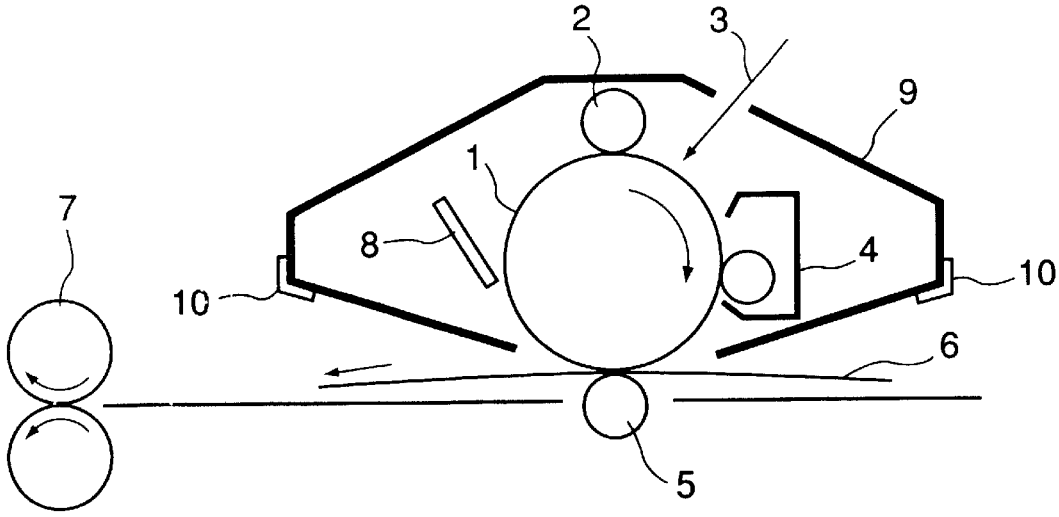
FIG. 1 schematically illustrate an organization of an electrophotographic apparatus equipped with a process-cartridge including an electrophotographic photosensitive member.

The electrophotographic apparatus and process-cartridge of the present invention use an electrophotographic photosensitive member which exhibits a specific range of charge mobility, thereby showing electrophotographic characteristics of being less liable to cause a density difference regardless of laser beam emission state and being less liable to cause ghost or potential fluctuation on repetitive use even without a charge-removal means, such as a pre-exposure means.

In an electrophotographic apparatus using a multi-beam exposure means, the occurrence of a density difference between an output image formed by simultaneous emission of adjacent plural laser beams and an output image formed by separate and sequential emission of the adjacent laser beams is considered to be associated with a superposition of laser beam spots and caused by a potential characteristic difference at such a spot-superposed portion of the photosensitive member.

In the case of simultaneous emission of two laser beams, a laser spot-superposed portion of the photosensitive member is illuminated with a combination of the two beams. On the other hand, in the case of separate and sequential emission of two laser beams, the illuminated portion of the photosensitive member is illuminated with each laser beam twice.

A phenomenon that a photosensitive member results in different potentials regardless of illumination with identical quantity of light is called a deviation from reciprocity law.

More specifically, a reciprocity law exists such that a potential V (volts) at an illuminated portion of an electrophotographic photosensitive member is determined as a function of illuminated light quantity E=I×t, i.e., a product of an illumination or emission intensity I and an exposure time t. However, at too large or too small an emission intensity I, the potential V on the photosensitive member can deviate from the the reciprocity law in spite of the illumination with an identical light quantity E. This is a phenomenon called a deviation from reciprocity law. In connection with the deviation from reciprocity law, JP-A 4-51043 has reported a phenomenon that an electrophotographic photosensitive member exhibits a higher sensitivity by repetition of illumination at relatively weak light intensities than a single time of illumination at a strong light intensity.

In this way, in an electrophotographic apparatus using a multi-beam exposure means, it is considered that a simultaneous emission of plural laser beams results in a lower sensitivity than a separate and sequential emission of the plural laser beams, thereby resulting in an output image density difference.

As a result of further study based on the above knowledge and noting a charge mobility of an electrophotographic photosensitive member, it has been found that if a photosensitive member showing a charge mobility of at most $2.0\times10^{-5}$ cm$^2$/v.s is illuminated with separate and sequential laser beams, a potential attenuation is less liable to occur at a laser spot-superposed portion between the first laser illumination to the subsequent laser illumination, thus being less liable to cause a potential difference compared with the case of simultaneous illumination with the laser beams.

Further, it has been also found that at a charge mobility in the range of $7.\times10^{-7}$ to $2.0\times10^{-5}$ cm$^2$/v.s, ghost or potential fluctuation on repetitive use is less liable to occur, whereby we have arrived at the present invention.

The reason for such a remarkable effect regarding the ghost or potential fluctuation on repetitive use has not been clarified as yet. It is however assumed that in the case of using plural laser beams, a lowering in sensitivity at a simultaneously illuminated portion results in an easier charge accumulation in the photosensitive member to affect the ghost or potential fluctuation on repetitive use, than in the case of a single laser beam.

More specifically, at a specifically set charge mobility, an appropriate degree of charge accumulation occurs but an increase in charge accumulation can be suppressed, so that the ghost is less liable to occur. Further, as for the potential fluctuation on repetitive use, at a specifically set level of charge mobility, it is assumed that the charge accumulation on repetitive use is retained at an appropriate level and adequately offsets a potential fluctuation factor which may be attributable to oxytitanium phthalocyanine.

Oxytitanium phthalocyanine used in the present invention is represented by the following structural formula (1):

(1)

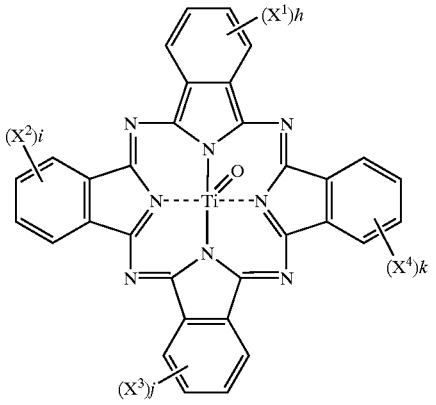

wherein $X^1$, $X^2$, $X^3$ and $X^4$ denote Cl or Br; and h, i, j and k denote an integer of 0–4.

In the present invention, oxytitanium phthalocyanine need not have a particularly limited crystal form but may preferably have a form represented by either strong peaks at Bragg angles (2θ±0.2 deg.) of 9.0 deg., 14.2 deg., 23.9 deg. and 27.1 deg., or strong peaks at Bragg angles (2θ±0.2 deg.) of 9.6 deg. and 27.3 deg., respectively as measured by CuKα characteristic X-ray diffraction in view of the sensitivity characteristic.

The electrophotographic photosensitive member used in the present invention exhibits a charge mobility in the range of $7.0\times10^{-7}$ to $2.0\times10^{-5}$ cm$^2$/V.s, more preferably $1.0\times10^{-6}$ to $1.0\times10^{-5}$ $cm^2/V.s$, particularly preferably $1.5\times10^{-6}$ to $6.5\times10^{-6}$ $cm^2/V.s$.

If the charge mobility is below $7.0\times10^{-7}$ $cm^2/V.s$, the effect against ghost and potential fluctuation on repetitive use is insufficient. On the other hand, if the charge mobility is above $2.0\times10^{-5}$ $cm^2/V.s$, the effects against the output image density difference depending on laser beam emission state and the potential fluctuation on repetitive use are insufficient.

The charge mobility defined in the present invention is a general characteristic value meaning a charge moving velocity per unit electric field intensity.

The charge mobility may ordinarily be measured according to the time-of-flight method, wherein a sample formed by sandwiching a photosensitive layer between a pair of electrodes is placed in an electric field by applying a voltage between the electrodes, and a light pulse is emitted to the photosensitive layer through the electrodes to observe a waveform of transient current passing between the electrodes in the course of movement of generated charges from one side to the other of the sample. The charge mobility can be derived by analyzing the transient current waveform.

However, as the charge mobility of an organic photoconductor substance depends on a set condition, particularly an electric field intensity, the charge mobility values ($cm^2$/volt.sec) described herein are based on measured values of time (sec) moving across the photosensitive layer thickness (cm) at an electric field intensity of Vd/D (volts/cm) based on a dark potential Vd (volts) and a photosensitive layer thickness D (cm) of a photosensitive member concerned. As the intermediate layer thickness is generally small compared with the photosensitive layer thickness, the presence of an intermediate layer need not be contemplated in calculation of the electric field intensity and the charge mobility ordinary cases.

The electrophotographic apparatus thus defined according to the present invention exhibits electrophotographic characteristics of being less liable to result in an output image density difference regardless of laser beam emission state even in the case where the influence of laser beam spot-superposition becomes larger, i.e., the case of a low electric field intensity of a photosensitive member or a high resolution of an electrophotographic apparatus, and also being less liable to cause ghost or potential fluctuation on repetitive use even with a charge-removal means, such as a pre-exposure means.

Further, the electrophotographic apparatus of the present invention exhibits an electrophotographic characteristic of being less liable to show an output image density difference regardless of a change in laser beam emission state, even in the case of a lower process speed, i.e., in the case of a longer laser beam scanning time.

More specifically, the electrophotographic apparatus exhibits a characteristic of being less liable to result in an output image density difference regardless of a change in laser beam emission state even at a process speed of at most 200 mm/s, particularly at most 100 mm/s.

Hereinbelow, some organization of an electrophotographic photosensitive member used in the electrophotographic apparatus and process-cartridge of the present invention will be described.

The electrophotographic photosensitive member used in the present invention has a photosensitive layer which may have either a single layer structure containing both a charge-transporting substance and a charge-generating substance in a single photosensitive layer or a laminate structure including a charge transport layer comprising a charge-transporting substance and a charge generation layer comprising a charge-generating substance. In view of electrophotographic property, the lamination-type structure is preferred and a photosensitive member including this type of photosensitive layer will be described for example.

The photosensitive member includes a support which may comprise any material having electroconductivity. Examples thereof may include: metals, such as aluminum and stainless steel, and structures of metal, paper or plastic provided with an electroconductive layer, in the form of a sheet or a cylinder.

In the case of using coherent light as exposure light, it is possible to dispose an electroconductive layer for the purpose of preventing the occurrence of interferential fringes due to scattering or masking damages on the support. Such an electroconductive layer may be formed by dispersing electroconductive powder, such as carbon black or metal particles, in a resin, in a thickness of preferably 5–40 $\mu$m, more preferably 10–30 $\mu$m.

It is also possible to insert an intermediate layer having an adhesive function and a barrier function. Examples of the material for the intermediate layer may include: polyamide, polyvinyl alcohol, polyethylene oxide, ethyl cellulose, casein, polyurethane, and polyether urethane. These materials may be dissolved in an appropriate solvent to be applied to form an intermediate layer having a thickness of preferably 0.05–5 $\mu$m, more preferably 0.3–1 $\mu$m.

The charge generation layer may be formed by preparing a dispersion liquid by uniformly dispersing a charge-generating substance together with an appropriate binder resin in an amount of 0.3–4 times it, and also a solvent by using dispersion means, such as a homogenizer, an ultrasonic disperser, a ball mill, a vibrating ball mill, a sand mill, an attritor, a roll mill or a liquid impingement-type high-speed dispersing machine, and applying the dispersion liquid, followed by drying.

The above-mentioned oxytitanium phthalocyanine is used as the charge generating substance.

Examples of the binder resin may include: polyvinyl butyral resin, phenoxy resin, polycarbonate resin, polyvinyl acetal resin, polystyrene resin and polyarylate resin. The charge generation layer may preferably be formed in a thickness of at most 5 $\mu$m, more preferably 0.1–2 $\mu$m.

The charge transport layer may be formed by applying and drying a coating liquid principally comprising a charge-transporting substance and a binder resin dissolved in a solvent.

Examples of the charge-transporting substance may include: triarylamine compounds, hydrazone compounds, stilbene compounds, pyrazoline compounds, oxazole compounds, triarylmethane compounds, and thiazole compounds.

Examples of the binder resin may include: acrylic resin, polyester resin, polyarylate resin, polyvinyl chloride resin, polycarbonate resin, polyvinyl butyral resin and polymethacrylate resin.

Such a charge-transporting substance and a binder resin may appropriately be combined so as to provide a charge mobility of $7.0\times10^{-7}$ to $2.0\times10^{-5}$ $cm^2/V.s$.

The content of the charge-transporting substance in the charge transport layer may preferably be below 50 wt. %, more preferably 42–46 wt. %.

The charge transport layer may preferably be formed in a thickness of 5–40 $\mu$m, more preferably 15–30 $\mu$m, particularly preferably 25–28 $\mu$m. However, as the charge transport layer thickness also affects the charge mobility, the thickness has to be set so as to provide a charge mobility of $7.0\times10^{-7}$ to $2.0\times10^{-5}$ $cm^2/V.s$.

Next, an exposure device used in the present invention will be described.

Figure 2:
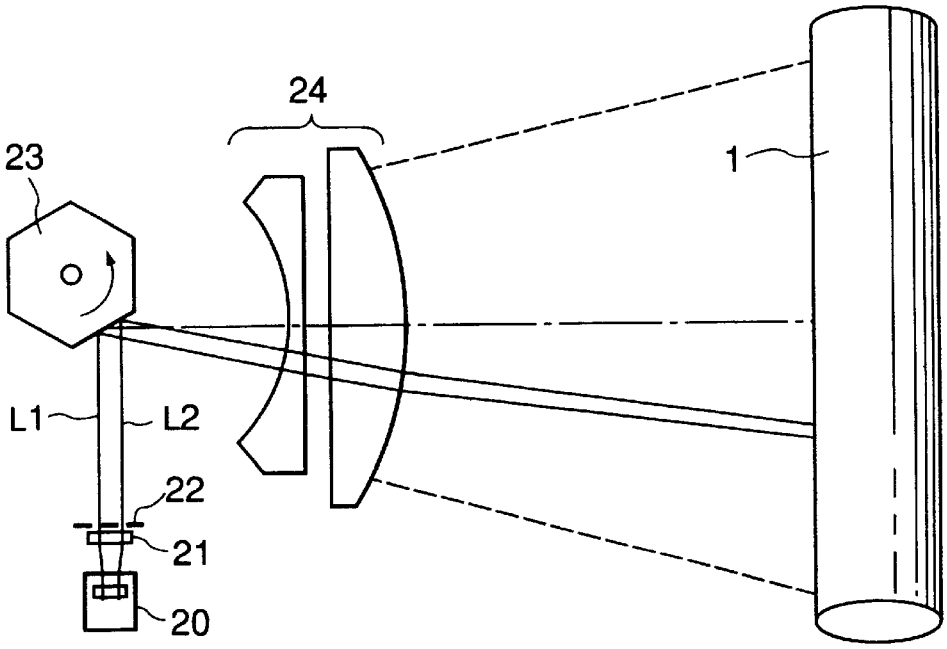
FIG. 2 schematically illustrates an organization of a multi-beam exposure device emitting two laser beams.

FIG. 2 schematically illustrates a multi-beam exposure device emitting two laser beams.

Referring to FIG. 2, the exposure device includes a semiconductor laser 20 as a laser beam emission source, a collimator lens 21 and a stop 22 for converting emitted laser beams into parallel light beams L1 and L2 each having a prescribed beam diameter, a polygonal mirror 23 rotating at a constant angular speed in an indicated arrow direction for reflecting laser beams incident thereto to continuously change the direction of emission of the reflected laser beams, and f-θ lenses 24 for focusing the reflected laser beams onto a photosensitive member 1.

Figure 3:
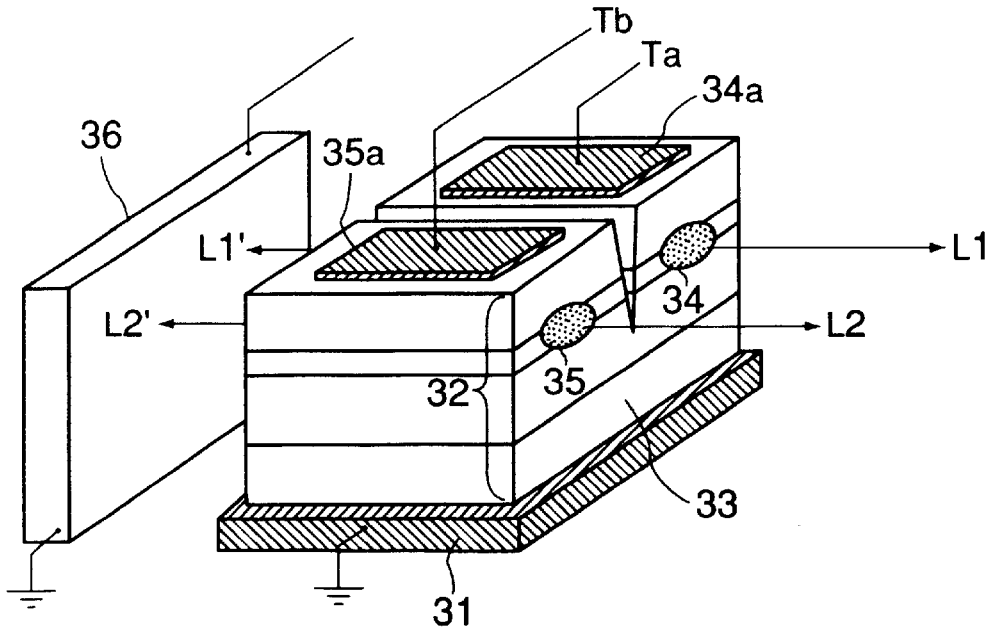
FIG. 3 schematically illustrates a semiconductor laser for emitting two laser beams.

The semiconductor laser 20 as an emission light source has a structure as illustrated in FIG. 3 so as to emit two laser beams. More specifically, the laser includes an electrode substrate 31 at a lower part and an LD (laser diode) chip 32 disposed thereon. The LD chip 32 is functionally divided into two diodes having two oscillator regions 34 and 35, respectively, disposed on a chip substrate 33 and separated with a separation groove. When drive currents are supplied from connection terminals Ta and Tb via electrodes 34*a* and 35*a*, the two laser diodes emit first and second laser beams L1 and L2 forward and back beams L1' and L2' backward. Further, the semiconductor laser 20 is provided with a photodiode 36 for receiving the back beams L1' and L2' and feeding received light quantity signals back to the laser beam emission bias supply to self-control bias currents, thereby stabilizing the laser beams L1 and L2.

FIG. 1 schematically illustrates an organization of an electrophotographic apparatus equipped with a process-cartridge including an electrophotographic photosensitive member according to the present invention.

Referring to FIG. 1, a drum-shaped electrophotographic photosensitive member 1 is rotated in an indicated arrow direction at a prescribed circumferential speed. In the course of its rotation, the photosensitive member 1 is uniformly charged to a positive or negative prescribed potential on its circumferential surface by a primary charging means 2 and receives plural laser beams 3 (only one being shown) emitted from a multi-beam exposure means (not shown) for emitting the plural laser beams and intensity-modified corresponding to time-serial electric digital signal of objective image data. As a result, an electrostatic latent image corresponding to the objective image data is sequentially formed on the circumferential surface of the photosensitive member 1.

The thus-formed electrostatic latent image is then developed with a toner by a developing means 4 to form thereon a toner image, which is then sequentially transferred onto a transfer (receiving) material 6 supplied from a paper-supply unit (not shown) to a transfer position between the photosensitive member 1 and a transfer means 5 in synchronism with the rotation of the photosensitive member 1 by the transfer means 5.

The transfer material 6 carrying the transferred toner image is then separated from the photosensitive member 1 and introduced into a fixing device 7, where the toner image is fixed onto the transfer material 6 to provide an image product (print or copy) to be discharged out of the apparatus.

The surface of the photosensitive member 1 after the image transfer is subjected to removal of transfer residual toner by a cleaning means 8 to be cleaned for a subsequent image formation thereon.

In the present invention, a plurality of the above-mentioned components, i.e., the electro-photographic photosensitive member 1, the primary charging means 2, the developing means 4, and the cleaning means 8, may be housed within a container to be supported integrally to form a process-cartridge 9, which is detachably mountable to a main assembly of the electrophotographic apparatus functioning as a copying machine, a laser beam printer, etc. For example, at least one of the primary charging means 2, the developing means 4 and the cleaning means 8 may be supported integrally together with the photosensitive member 1 to form a process-cartridge, which can be detachably mountable to an apparatus main assembly by a guide means, such as rails 10.

Hereinbelow, the present invention will be described more specifically based on Examples, wherein "part(s)" means "parts by weight".

EXAMPLE 1

An aluminum cylinder of 30 mm in diameter and 260 mm in length was coated with a paint having a composition as follows, followed by drying and heat-curing at 140° C. for 30 min., to form a 15 μm-thick electroconductive layer.

| | |
|---|---|
| $SnO_2$-coated barium sulfate (electroconductive pigment) | 10 part(s) |
| Titanium oxide (resistivity-adjusting pigment) | 2 part(s) |
| Phenolic resin (binder resin) | 6 part(s) |
| Methanol/methoxypropanol (2/8 by weight) mixture solvent | 20 part(s) |

The coated aluminum cylinder was further coated with a solution of 3 parts of N-methoxy-methylated nylon and 3 parts of copolymer nylon in a mixture solvent of methanol 65 parts/n-butanol 30 parts by dipping, followed by drying, to form a 0.5 μm-thick intermediate layer.

Then, 4 parts of oxytitanium phthalocyanine characterized by strong peaks at Bragg angles (2θ+0.2 deg.) of 9.0 deg., 14.2 deg., 23.9 deg. and 27.1 deg., 4 parts of polyvinyl butyral ("Eslec BM2", made by Sekisui Kagaku K.K.) and 60 parts of cyclohexanone were dispersed for 4 hours in a sand mill, and diluted with 100 parts of ethyl acetate to form a charge generation layer-forming paint, which was then applied by dipping on the intermediate layer and dried to form a 0.2 μm-thick charge generation layer.

Then, 8 parts of a compound represented by a structural formula (2) below and a compound represented by a structural formula (3) shown below were dissolved together with 12 parts of polycarbonate Z resin (hereinafter sometimes abbreviated as "PC-Z") (weight-average molecular weight (Mw)=$10^5$) in a mixture solvent of monochlorobenzene 60 parts/dichloromethane 40 parts to form a charge transport layer-forming paint.

(2)

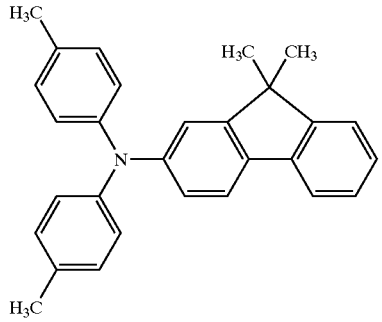

(3)

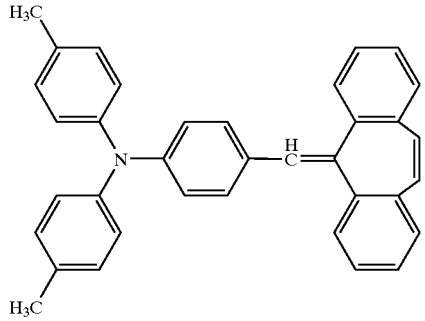

The charge transport layer-forming paint was applied by dipping on the charge generation layer and dried at 110° C. for 2 hours to form a 25 μm-thick charge transport layer.

Separately, the above-mentioned electroconductive layer, intermediate layer, charge generation layer and charge transport layer were formed in respectively identical thicknesses on an aluminum sheet, and a semitransparent Au electrode was formed thereon to measure a charge mobility according to the TOF (time-of-flight) method. For the measurement, a voltage of 700 volts (as a prescribed dark potential) was applied between the aluminum sheet and the Au electrode, and pulsed laser light having a wavelength of 680 was irradiated to generate charges from the charge generation layer, whereby the resultant current waveform was measured by a high-speed current amplifier ("Keithlay 428") and a digital oscilloscope ("Tektronix TDS 420A). The transit time was determined according to the Scher-Montroll method, wherein a current (I)–time (t) relationship is converted into a logarithmic curve, on which a flexural point is used for determining the transit time.

As a result, a charge mobility of $6.3\times10^{-6}$ $cm^2$/volt.sec was measured at an electric field intensity (E.F.I) of $2.8\times10^5$ ($=700/25.2\times10^{-3}$) volts/cm.

The above-prepared photosensitive member was subjected to performance evaluation by incorporating it in a commercially available laser beam printer ("Laser Jet 4000", made by Hewlett-Packard, Co., a process speed of 94 mm/sec and a resolution of 600 dpi) including no charge-removal means after remodeling for incorporating a multi-beam exposure device for emitting two laser beams to provide a process speed of 190 mm/s and a resolution of 600 dpi. The dark-part potential and the light-part potential were set to −700 volts and −15 volts, respectively. Imae formation and evaluation were performed with respect to the following items.

<Halftone>

In an environment of 23° C./50%RH, two types of halftone images were formed, i.e., a halftone image of two-dot lines formed by simultaneous emission of two laser beams and a halftone image of two-dot lines formed by sequential emission of the laser beams, thereby evaluating a difference in image density between the two types of halftone image. The evaluation was performed with eyes according to the following standard.

A: No recognizable density difference.

B: A slight density difference.

C1: A noticeable but better level of density difference.

C2: A noticeable and worse level of density difference.

D: A remarkable density difference.

<Ghost>

Next, the laser beam printer was used for continuous printing of lateral line images at an image areal percentage of 5% on 1000 sheets in an environment of 23° C./50%RH. At an initial stage and after 1000 sheets of the continuous image formation, an image pattern comprising a sequence of a solid black and white stripe image and a subsequent halftone image was formed to effect ghost evaluation according to the following standard.

A: No ghost recognizable on the halftone image.

B: A slightly higher density at a halftone image following a black stripe image.

C1: A higher density but with a less noticeable level at a halftone image following a black stripe image.

C2: A higher density and with a more noticeable level at a halftone image following a solid black stripe image.

D: A clearly higher density at a halftone image following a solid black image stripe.

B': A slightly lower density at a halftone image following a black stripe image.

C1': A lower density but with a less noticeable level at a halftone image following a black stripe image.

C2': A lower density and with a more noticeable level at a halftone image following a black stripe image.

D': A clearly lower density at a halftone image following a solid black image stripe.

<Potential Fluctuation (ΔV1)>

Further, the laser beam printer was subjected to a continual printing test on 500 sheets according to an intermittent mode wherein a random continuation of a solid white pattern, a solid black pattern, a halftone and a character pattern at an image areal percentage of 4% was reproduced continually with a pause period after each printing on one sheet, for evaluation of potential characteristic. More specifically, the light part potential on the photosensitive member was measured at an initial stage and at every point after printing on 200 sheets each, and a maximum potential difference (ΔV1) between two points of time throughout the continual printing on 5000 sheets was recorded as a potential fluctuation. Therefore, the intermittent continual printing test was performed on further 5000 sheets (i.e., totally 10,000 sheets), and a maximum potential difference (ΔV1) was determined similarly for the total printing test on 10,000 sheets.

The results of the above evaluation items are inclusively shown in Table 1 appearing hereinafter together with those of the following examples.

EXAMPLE 2

An electrophotographic photosensitive member was prepared and evaluated in the same manner as in Example 1 except for decreasing the charge transport layer thickness to 19 μm.

EXAMPLE 3

An electrophotographic photosensitive member was prepared and evaluated in the same manner as in Example 1 except for using 15 parts of the compound of the formula (2) and 3 parts of the compound of the formula (3) as charge-transporting substances for the charge transport layer.

EXAMPLE 4

An electrophotographic photosensitive member was prepared and evaluated in the same manner as in Example 1 except for using 5 parts of the compound of the formula (2) and 1 part of the compound of the formula (3) as charge-transporting substances for the charge transport layer.

EXAMPLE 5

An electrophotographic photosensitive member was prepared and evaluated in the same manner as in Example 1 except for using 8 parts of a compound of a structure formula (4) shown below and 2 parts of a compound of a structural formula (5) shown below as charge-transporting substances for the charge transport layer.

(4)

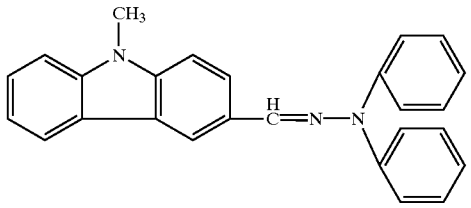

(5)

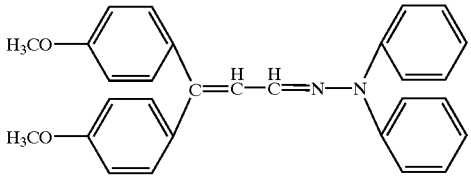

EXAMPLE 6

An electrophotographic photosensitive member was prepared and evaluated in the same manner as in Example 1 except for using 14 parts of a compound of a structure formula (6) shown below as the charge-transporting substance for the charge transport layer.

(6)

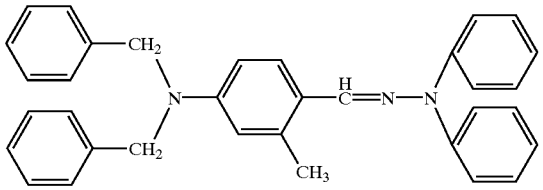

EXAMPLE 7

The process for producing the electrophotographic photosensitive member in Example 1 was repeated up to the formation of the charge generation layer. Then, for the formation of a charge transport layer thereon, 10 parts of the compound of the formula (2) and 10 parts a resin (Mw=$10^5$) represented by a recurring unit of a formula (7) shown below in a mixture solvent of monochlorobenzene 80 parts/dichloromethane 40 parts to provide a charge transport layer-forming paint.

(7)

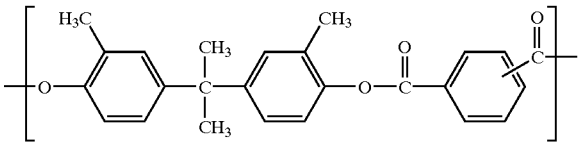

The paint was applied by dipping on the charge generation layer and dried at 110° C. for 2 hours to form a 25 μm-thick charge transport layer.

The thus-obtained photosensitive member was evaluated in the same manner as in Example 1.

EXAMPLE 8

The process for producing the electrophotographic photosensitive member in Example 1 was repeated up to the formation of the charge generation layer. Then, for the formation of a charge transport layer thereon, 10 parts of tetrafluoroethylene resin particles ("Lublon L-2", made by Daikin K.K.), 10 parts of polycarbonate Z resin (Mw=5×$10^4$) and 0.06 part of a fluorine-containing comb-shaped graft copolymer ("GF300", made by Toa Kasei K.K.) were sufficiently mixed with 60 parts of monochlorobenzene and dispersed by a high-pressure dispersing machine to prepare a tetrafluoroethylene resin particle-dispersion liquid.

Then, 8 parts of the compound of the formula (2), 3 parts of the compound of the formula (3), 6 parts of polycarbonate Z resin (Mw=5×$10^4$) and 6 pats of polycarbonate Z resin (Mw=2×$10^4$) were mixed with 16 parts of the above-prepared tetrafluoroethylene resin particle-dispersed dispersion liquid and diluted with a mixture solvent of monochlorobenzene 40 parts/dichloromethane 30 parts to form a charge transport layer-forming paint.

The charge transport layer-forming paint was then applied by dipping on the above-prepared charge generation layer to form a 25 μm-thick charge transport layer.

The thus-obtained photosensitive member was evaluated in the same manner as in Example 1.

EXAMPLE 9

The preparation and evaluation of an electrophotographic photosensitive member were performed in the same manner as in Example 1 except for changing the process speed of the laser beam printer to 150 mm/sec.

EXAMPLE 10

The preparation and evaluation of an electrophotographic photosensitive member were performed in the same manner as in Example 1 except for changing the process speed of the laser beam printer to 210 mm/sec.

EXAMPLE 11

The preparation and evaluation of an electrophotographic photosensitive member were performed in the same manner as in Example 1 except for changing the resolution of the laser beam printer to 1200 dpi.

EXAMPLE 12

The preparation and evaluation of an electrophotographic photosensitive member were performed in the same manner as in Example 3 except for changing the process speed of the laser beam printer to 150 mm/sec.

EXAMPLE 13

The preparation and evaluation of an electrophotographic photosensitive member were performed in the same manner as in Example 2 except for changing the process speed of the laser beam printer to 150 mm/sec.

EXAMPLE 14

The preparation and evaluation of an electrophotographic photosensitive member were performed in the same manner as in Example 4 except for changing the process speed of the laser beam printer to 210 mm/sec.

EXAMPLE 15

The preparation and evaluation of an electrophotographic photosensitive member were performed in the same manner as in Example 5 except for changing the process speed of the laser beam printer to 210 mm/sec.

EXAMPLE 16

The preparation and evaluation of an electrophotographic photosensitive member were performed in the same manner as in Example 3 except for changing the resolution of the laser beam printer to 1200 dpi.

EXAMPLE 17

The preparation and evaluation of an electrophotographic photosensitive member were performed in the same manner as in Example 2 except for changing the resolution of the laser beam printer to 1200 dpi.

EXAMPLE 18

The preparation and evaluation of an electrophotographic photosensitive member were performed in the same manner as in Example 5 except for changing the resolution of the laser beam printer to 1200 dpi.

EXAMPLE 19

The preparation and evaluation of an electrophotographic photosensitive member were performed in the same manner as in Example 4 except for changing the resolution of the laser beam printer to 1200 dpi.

EXAMPLE 20

The preparation and evaluation of an electrophotographic photosensitive member were performed in the same manner as in Example 1 except for changing the amount of the compound of the formula (2) to 7 parts and changing the charge transport layer thickness to 28 $\mu$m.

EXAMPLE 21

The preparation and evaluation of an electrophotographic photosensitive member were performed in the same manner as in Example 20 except for changing the process speed of the laser beam printer to 150 mm/sec.

EXAMPLE 22

The preparation and evaluation of an electrophotographic photosensitive member were performed in the same manner as in Example 1 except for changing the resolution of the laser beam printer to 1200 dpi.

COMPARATIVE EXAMPLE 1

An electrophotographic photosensitive member was prepared and evaluated in the same manner as in Example 1 except for using 24 parts of the compound of the formula (2) as the charge-transporting substance of the charge transport layer.

COMPARATIVE EXAMPLE 2

An electrophotographic photosensitive member was prepared and evaluated in the same manner as in Example 1 except for using 5 parts of the compound of the formula (3) as the charge-transporting substance of the charge transport layer.

COMPARATIVE EXAMPLE 3

The preparation and evaluation of an electrophotographic photosensitive member were performed in the same manner as in Comparative Example 1 except for changing the process speed of the laser beam printer to 150 mm/sec.

COMPARATIVE EXAMPLE 4

The preparation and evaluation of an electrophotographic photosensitive member were performed in the same manner as in Comparative Example 2 except for changing the process speed of the laser beam printer to 210 mm/sec.

COMPARATIVE EXAMPLE 5

The preparation and evaluation of an electrophotographic photosensitive member were performed in the same manner as in Comparative Example 1 except for changing the resolution of the laser beam printer to 1200 dpi.

COMPARATIVE EXAMPLE 6

The preparation and evaluation of an electrophotographic photosensitive member were performed in the same manner as in Comparative Example 2 except for changing the process speed of the laser beam printer to 1200 dpi.

REFERENCE EXAMPLE 1

The preparation and evaluation of an electrophotographic photosensitive member were performed in the same manner as in Comparative Example 1 except for using a single laser beam exposure means and correspondingly increasing the polygonal mirror rotation speed to twice as fast as that in Comparative Example 1, i.e., that in Example 1.

REFERENCE EXAMPLE 2

The preparation and evaluation of an electrophotographic photosensitive member were performed in the same manner as in Comparative Example 2 except for using a single laser beam exposure means and correspondingly increasing the polygonal mirror rotation speed to twice as fast as that in Comparative Example 2, i.e., that in Example 1.

REFERENCE EXAMPLE 3

The process for producing the electrophotographic photosensitive member in Example 1 was repeated up to the formation of the intermediate layer. Then, for the formation of a charge generation layer, 4 parts of a charge-generating substance (azo pigment) represented by a structural formula shown below and 70 parts of tetrahydrofuran were dispersed for 10 hours in a sand mill containing 1 mm-dia. glass beads, and further blended with a solution of 2 parts of polyvinyl butyral resin ("Eslec BLS", made by Sekisui Kagaku K.K.) in 20 parts of tetrahydrofuran, followed by further 2 hours of dispersion. The dispersion liquid was then separated from the glass beads and diluted with 100 parts of cyclohexanone to form a charge generation layer-forming liquid.

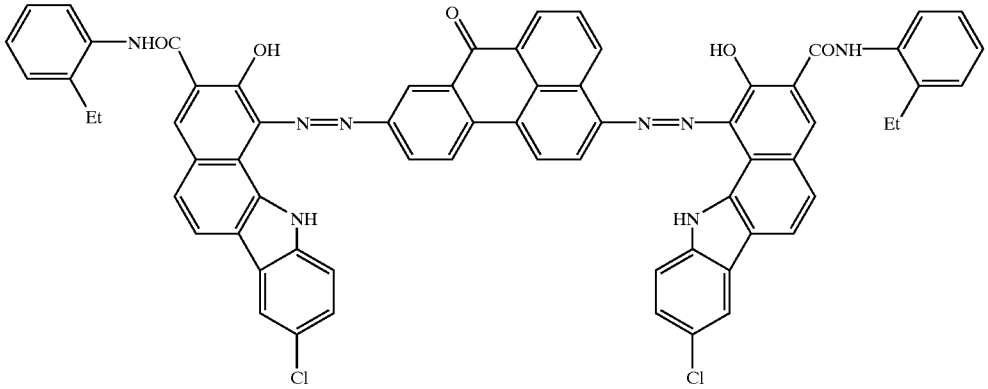

The charge generation layer-forming paint was then applied by dipping on the intermediate layer to form a 0.2 μm-thick charge generation layer, which was then coated with a 25 μm-thick charge transport layer in the same manner as in Comparative Example 1.

The resultant electrophotographic photosensitive member was evaluated in the same manner as in Example 1.

REFERENCE EXAMPLE 4

The process for preparing the electrophotographic photosensitive member was repeated up to the formation of the charge generation layer in the same manner as in Reference Example 3, and the charge generation layer was further coated with a 25 μm-thick charge transport layer in the same manner as in Comparative Example 2.

The resultant electrophotographic photosensitive member was evaluated in the same manner as in Example 2.

The outline of evaluation conditions and evaluation results of the above-mentioned Examples are inclusively shown in Table 1 below.

TABLE 1

Outline of Evaluation Conditions and Evaluation Results

| | Charge-transport layer | | | | | | | | | Evaluation results | | | |
|---|---|---|---|---|---|---|---|---|---|---|---|---|---|
| | | | | | | | | | | Ghost | | Δ Vl (volts) | |
| Example | Substance formula [parts] | Binder | Thickness (μm) | Number of L.B. | Process speed [mm/s] | Resolution (dpi) | E.F.I. (V/cm) | Charge Mobility [$cm^2/Vs$] | Halftone | Initial | After 5000 sheets | During 5000 sheets | During 10000 sheets |
| 1 | (2)8 (3)2 | PC-Z | 25 | 2 | 190 | 600 | $2.8 \times 10^5$ | $6.3 \times 10^{-6}$ | A | A | B | 20 | 20 |
| 2 | (2)8 (3)2 | PC-Z | 19 | 2 | 190 | 600 | $3.6 \times 10^5$ | $1.0 \times 10^{-5}$ | A | A | A | 20 | 45 |
| 3 | (2)15 (3)3 | PC-Z | 25 | 2 | 190 | 600 | $2.8 \times 10^5$ | $2.0 \times 10^{-5}$ | B | B' | A | 20 | 40 |
| 4 | (2)5 (3)1 | PC-Z | 25 | 2 | 190 | 600 | $2.8 \times 10^5$ | $7.0 \times 10^{-7}$ | A | B | B | 25 | 40 |
| 5 | (4)8 (5)2 | PC-Z | 25 | 2 | 190 | 600 | $2.8 \times 10^5$ | $1.5 \times 10^{-6}$ | A | A | B | 15 | 20 |
| 6 | (6)14 | PC-Z | 25 | 2 | 190 | 600 | $2.8 \times 10^5$ | $8.5 \times 10^{-7}$ | A | B | B | 20 | 35 |
| 7 | (2)10 | P-Ar | 25 | 2 | 190 | 600 | $2.8 \times 10^5$ | $4.5 \times 10^{-6}$ | A | A | B | 15 | 35 |
| 8 | (2)8 (3)2 | PC-Z | 25 | 2 | 190 | 600 | $2.8 \times 10^6$ | $5.6 \times 10^{-6}$ | A | A | B | 15 | 15 |
| 9 | (2)8 (3)2 | PC-Z | 25 | 2 | 150 | 600 | $2.8 \times 10^5$ | $6.3 \times 10^{-6}$ | B | A | B | 15 | 15 |
| 10 | (2)8 (3)2 | PC-Z | 25 | 2 | 210 | 600 | $2.8 \times 10^5$ | $6.3 \times 10^{-6}$ | A | A | B | 20 | 20 |
| 11 | (2)8 (3)2 | PC-Z | 25 | 2 | 190 | 1200 | $2.8 \times 10^5$ | $6.3 \times 10^{-6}$ | B | B | B | 20 | 20 |
| 12 | (2)15 (3)3 | PC-Z | 25 | 2 | 150 | 600 | $2.8 \times 10^5$ | $2.0 \times 10^{-5}$ | Cl | B' | A | 20 | 40 |
| 13 | (2)8 (3)2 | PC-Z | 19 | 2 | 150 | 600 | $3.6 \times 10^5$ | $1.0 \times 10^{-5}$ | A | A | A | 20 | 45 |
| 14 | (2)15 (3)3 | PC-Z | 25 | 2 | 210 | 600 | $2.8 \times 10^5$ | $7.0 \times 10^{-7}$ | A | B | Cl | 20 | 40 |
| 15 | (4)8 (5)2 | PC-Z | 25 | 2 | 190 | 600 | $2.8 \times 10^5$ | $1.5 \times 10^{-6}$ | A | A | B | 20 | 20 |
| 16 | (2)15 (3)3 | PC-Z | 25 | 2 | 190 | 1200 | $2.8 \times 10^5$ | $2.0 \times 10^{-5}$ | Cl | B' | A | 25 | 40 |

TABLE 1-continued

Outline of Evaluation Conditions and Evaluation Results

| | Charge-transport layer | | | | | | | | | Evaluation results | | | |
|---|---|---|---|---|---|---|---|---|---|---|---|---|---|
| | | | | | | | | | | Ghost | | Δ Vl (volts) | |
| Example | Substance formula [parts] | Binder | Thickness (μm) | Number of L.B. | Process speed [mm/s] | Resolution (dpi) | E.F.I. (V/cm) | Charge Mobility [$cm^2$/Vs] | Half-tone | Initial | After 5000 sheets | During 5000 sheets | During 10000 sheets |
| 17 | (2)8 (3)2 | PC-Z | 19 | 2 | 190 | 1200 | $3.6 \times 10^5$ | $1.0 \times 10^{-5}$ | B | A | A | 20 | 45 |
| 18 | (4)8 (5)2 | PC-Z | 25 | 2 | 190 | 1200 | $2.8 \times 10^5$ | $1.5 \times 10^{-6}$ | A | A | B | 20 | 20 |
| 19 | (2)5 (3)1 | PC-Z | 25 | 2 | 190 | 1200 | $2.8 \times 10^5$ | $7.0 \times 10^{-7}$ | A | B | Cl | 25 | 40 |
| 20 | (2)7 (3)2 | PC-Z | 28 | 2 | 190 | 600 | $2.5 \times 10^5$ | $4.6 \times 10^{-6}$ | A | A | B | 15 | 20 |
| 21 | (2)7 (3)2 | PC-Z | 28 | 2 | 150 | 600 | $2.5 \times 10^5$ | $4.6 \times 10^{-6}$ | B | A | B | 15 | 20 |
| 22 | (2)7 (3)2 | PC-Z | 28 | 2 | 190 | 1200 | $2.5 \times 10^5$ | $4.6 \times 10^{-6}$ | B | B | B | 15 | 15 |
| Comp. 1 | (2)24 | PC-Z | 25 | 2 | 190 | 600 | $2.8 \times 10^5$ | $3.2 \times 10^{-5}$ | C2 | B' | A | 35 | 60 |
| Comp. 2 | (3)5 | PC-Z | 25 | 2 | 190 | 600 | $2.8 \times 10^5$ | $6.0 \times 10^{-7}$ | A | B | C2 | 40 | 65 |
| Comp. 3 | (2)24 | PC-Z | 25 | 2 | 150 | 600 | $2.8 \times 10^5$ | $3.2 \times 10^{-5}$ | D | B' | A | 35 | 45 |
| Comp. 4 | (3)5 | PC-Z | 25 | 2 | 210 | 600 | $2.8 \times 10^5$ | $6.0 \times 10^{-7}$ | A | B | D | 45 | 45 |
| Comp. 5 | (2)24 | PC-Z | 25 | 2 | 190 | 1200 | $2.8 \times 10^5$ | $3.2 \times 10^{-5}$ | D | B' | A | 40 | 60 |
| Comp. 6 | (3)5 | PC-Z | 25 | 2 | 190 | 1200 | $2.8 \times 10^5$ | $6.0 \times 10^{-7}$ | B | Cl | D | 45 | 65 |
| Ref. 1 | (2)24 | PC-Z | 25 | 1 | 190 | 600 | $2.8 \times 10^5$ | $3.2 \times 10^{-5}$ | A | B' | A | 40 | 60 |
| Ref. 2 | (3)5 | PC-Z | 25 | 1 | 190 | 600 | $2.8 \times 10^5$ | $6.0 \times 10^{-7}$ | A | A | B | 40 | 65 |
| Ref. 3* | (2)24 | PC-Z | 25 | 2 | 190 | 600 | $2.8 \times 10^5$ | $3.2 \times 10^{-5}$ | B | A | A | 25 | 25 |
| Ref. 4* | (3)5 | PC-Z | 25 | 2 | 190 | 600 | $2.8 \times 10^5$ | $6.0 \times 10^{-7}$ | A | A | B | 25 | 25 |

*Reference Examples 3 and 4 used an azo pigment as a charge-generating substance and resulted in lower image densities due to an insufficient sensitivity.

As has been described above and as is understood from the results shown in Table 1 above, according to the present invention, there are provided an electrophotographic apparatus and a process-cartridge therefor which are less liable to cause a density difference regardless of laser beam emission state, or ghost or potential fluctuation on repetitive use even in a system of using a multi-beam exposure means and without a charge-removal means, such as a pre-exposure means.

What is claimed is:

1. An electrophotographic apparatus, including:

an electrophotographic photosensitive member comprising a support and a photosensitive layer thereon:

charging means for charging said photosensitive member;

a multi-beam exposure means for illuminating said photosensitive member with a plurality of laser beams to form an electrostatic latent image on said photosensitive member;

a developing means for developing the electrostatic latent image to form a toner image on said photosensitive member; and transfer means for transferring the toner image from said photosensitive member to a transfer-receiving material, wherein said electrophotographic apparatus is not equipped with a charge-removal means for uniformly charge-removing the charge from said photosensitive member in advance of operation of said charging means, and the photosensitive layer contains oxytitanium phthalocyanine and the photosensitive member exhibits a charge mobility of $7.0\times10^{-5}$ to $2.0\times10^{-5}$ $cm^2$/volt sec.

2. The electrophotographic apparatus according to claim 1, wherein said photosensitive member is charged to a potential producing an electric field intensity of at most $3.5\times10^{-5}$ volts/cm.

3. The electrophotographic apparatus according to claim 1, wherein said electrophotographic apparatus is operated at a resolution of at least 1200 dpi (dots/inch).

4. The electrophotographic apparatus according to claim 1, wherein said electrophotographic apparatus is operated at a process speed of at most 200 mm/sec.

5. The electrophotographic apparatus according to claim 1, wherein said transfer means includes first transfer means for transferring the toner image on said photosensitive member to an intermediate transfer member and second transfer means for transferring the toner image on the intermediate transfer member to the transfer-receiving material.

6. The electrophotographic apparatus according to claim 1, wherein said photosensitive layer is functionally separated into a charge generation layer containing a charge-generating substance and a charge transport layer containing a charge-transporting substance.

7. The electrophotographic apparatus according to claim 6, wherein said charge transport layer is a surfacemost layer of said photosensitive member.

8. The electrophotographic apparatus according to claim 6, wherein said charge transport layer has a thickness of 25–28 μm.

9. The electrophotographic apparatus according to claim 6, wherein the charge-transporting substance is contained in a proportion of 42–46 wt. % of said charge transport layer.

10. The electrophotographic apparatus according to claim 1, wherein said photosensitive member exhibits a charge mobility of $1.5\times10^{-6}$ to $6.5\times10^{-6}$ $cm^2$/volt sec.

11. A process cartridge for an electrophotographic apparatus of the type including an electrophotographic photosensitive member comprising a support and a photosensitive layer thereon, charging means for charging the photosensitive member, multi-beam exposure means for illuminating the photosensitive member with a plurality of laser beams to form an electrostatic latent image on the photosensitive member, developing means for developing the electrostatic latent image to form a toner image on the photosensitive member, and transfer means for transferring the toner image from the photosensitive member to a transfer-receiving material, and not including a charge-removal means for uniformly charge-removing the charge from the photosensitive member in advance of operation of the charging means, wherein said process cartridge includes at least one of the photosensitive member, the charging means, and the developing means, which are integrally supported to form a cartridge that is detachably mountable to a main assembly of the electrophotographic apparatus, and the photosensitive layer contains oxytitanium phthalocyanine and the photosensitive member exhibits a charge mobility of $7.0\times10^{-5}$ to $2.0\times10^{-5}$ $cm^2$/volt sec.

12. The process cartridge according to claim 11, wherein the photosensitive layer is functionally separated into a charge generation layer containing a charge-generating substance and a charge transport layer containing a charge-transporting substance.

13. The process cartridge according to claim 12, wherein the charge transport layer is a surfacemost layer of the photosensitive member.

14. The process cartridge according to claim 12, wherein the charge transport layer has a thickness of 25–28 $\mu$m.

15. The process cartridge according to claim 12, wherein the charge-transporting substance is contained in a proportion of 42–46 wt. % of the charge transport layer.

16. The process cartridge according to claim 11, wherein the photosensitive member exhibits a charge mobility of $1.5\times10^{-6}$ to $6.5\times10^{-6}$ $cm^2$/volt sec.

* * * * *

UNITED STATES PATENT AND TRADEMARK OFFICE

CERTIFICATE OF CORRECTION

PATENT NO. : 6,703,174 B2
DATED : March 9, 2004
INVENTOR(S) : Wataru Kitamura et al.

It is certified that error appears in the above-identified patent and that said Letters Patent is hereby corrected as shown below:

Column 1,
Line 36, “10 known” should read -- known --.

Column 5,
Line 34, “mobility” should read -- mobility in --.

Column 17,
Line 44, “thereon:” should read -- thereon; --.

Signed and Sealed this

Sixth Day of July, 2004

JON W. DUDAS
*Acting Director of the United States Patent and Trademark Office*